US006794809B2

(12) United States Patent
Chigusa et al.

(10) Patent No.: US 6,794,809 B2
(45) Date of Patent: Sep. 21, 2004

(54) DISPLAY UNIT HAVING ANTIREFLECTION ANTISTATIC FILM AND MANUFACTURING METHOD THEREOF

(75) Inventors: Hisashi Chigusa, Saitama (JP); Daiki Takahashi, Saitama (JP); Michiyo Abe, Tomioka (JP); Katsuyuki Aoki, Honjo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 167 days.

(21) Appl. No.: 10/076,389

(22) Filed: Feb. 19, 2002

(65) Prior Publication Data

US 2002/0153824 A1 Oct. 24, 2002

(30) Foreign Application Priority Data

Feb. 20, 2001 (JP) ..... P2001-43799

(51) Int. Cl.[7] ..... H01J 29/88

(52) U.S. Cl. ..... 313/479; 313/478; 313/112; 313/113; 428/446; 428/447

(58) Field of Search ..... 313/479, 477 R, 313/478, 477 HC, 480; 428/446, 447, 328, 428, 637; 427/366

(56) References Cited

U.S. PATENT DOCUMENTS 4,904,525 A * 2/1990 Taniguchi et al. ..... 428/328
5,218,268 A * 6/1993 Matsuda et al. ..... 313/478
5,444,329 A 8/1995 Matsuda et al. ..... 313/479
5,520,855 A * 5/1996 Ito et al. ..... 252/582
5,965,975 A * 10/1999 Chigusa et al. ..... 313/478

FOREIGN PATENT DOCUMENTS

| | | |
|---|---|---|
| EP | 0940 837 A1 | 9/1999 |
| EP | 0999 458 A2 | 5/2000 |
| JP | 7-307133 | 11/1995 |
| JP | 8-7797 | 1/1996 |
| JP | 9-22669 | 1/1997 |
| JP | 11-250834 | 9/1999 |
| JP | 2000-47006 | 2/2000 |
| JP | 2000-111705 | 4/2000 |
| JP | 2000-260356 | 9/2000 |
| JP | 2002-190265 | 7/2002 |

* cited by examiner

*Primary Examiner*—Nimeshkumar D. Patel
*Assistant Examiner*—Sikha Roy
(74) *Attorney, Agent, or Firm*—Pillsbury Winthrop LLP

(57) ABSTRACT

A display unit has a face surface and a multi-layered antireflection antistatic film composed of three layers or more which are formed on the face surface. The multi-layered antireflection antistatic film has an absorption layer, a conductive layer, and a protect layer in the order from a face surface side. The absorption layer includes at least one kind of organic coloring matter, $SiO_2$, and a silane coupling agent, and the silane coupling agent content thereof is seven times or less by weight the total solid content of $SiO_2$ and the organic coloring matter.

9 Claims, 1 Drawing Sheet

DISPLAY UNIT HAVING ANTIREFLECTION ANTISTATIC FILM AND MANUFACTURING METHOD THEREOF

CROSS REFERENCE TO RELATED APPLICATIONS

This application is based upon and claims the benefit of priority from the prior Japanese Patent Application No. 2001-43799, filed on Feb. 20, 2001; the entire contents of which are incorporated herein by reference.

BACKGROUND OF THE INVENTION

1. Field of the Invention

The present invention relates to a display unit and a manufacturing method thereof, and more particularly to an antireflection antistatic film formed on a face surface of a Braun tube.

2. Description of the Related Art

It is possible to cause a surface treatment film of a display device to have an antireflection antistatic function, a function of lowering transmittance of a face surface of the display unit and improving contrast of a picture, and so forth. Furthermore, by causing the surface treatment film to have a wavelength selective absorption characteristic, color purity of luminous color can be improved. Moreover, it is also possible to cause a Braun tube to have not only the antistatic function but also an electromagnetic shield function.

In view of the above, a two-layered antireflection antistatic film composed of a conductive layer made of metal minute particles and a protect layer made of $SiO_2$ has recently been utilized. For this conductive layer, at least one kind of metal minute particles or metal compound minute particles selected from metals belonging to 3A, 4A, 5A, 6A, 7A, 8, 1B, 2B, 3B, 4B, and 5B groups is used. Especially when metal minute particles, for example, an Ag—Pd alloy, an Au—Pd alloy, and so on, which themselves have a light absorption characteristic, are used, the surface treatment film can have the function of lowering the transmittance of the surface treatment film and improving contrast of a picture.

In manufacturing this two-layered antireflection antistatic film, it is necessary to take productivity such as treating time required for film formation and plant investment into consideration. From the viewpoint of such productivity, a wet method is often used in manufacturing the two-layered antireflection antistatic film. As this wet method, for example, a spin-coating method, a dipping method, and so forth can be named.

The spin-coating method is a method of forming a film by dispersing a solution uniformly over a surface through the use of a centrifugal force resulting from the rotation of the surface. The dipping method is a method of forming a film uniformly through the use of dispersion due to self-weight of a solution onto the surface.

However, the decrease in the transmittance of the conductive layer in order to improve the contrast of a picture causes noticeable uneven coating of the conductive layer and is likely to cause deterioration in picture quality. A multi-layered structure in which an absorption layer including organic coloring matter and so on is provided in addition to the conductive layer made of the metal minute particles is an effective solution to such problem.

In general, drying at a relatively low temperature and for a short treating time is preferable for the film formation from the viewpoint of productivity. Such drying condition for the film formation is preferably, for example, a temperature of approximately 20° C. to 35° C. and approximately one to five minute treating time.

However, when the multi-layered antireflection antistatic film having the aforesaid absorption layer is to be formed under the preferable condition determined from the viewpoint of high productivity, such as the relatively low temperature and short treating time as described above, substances constituting the conductive layer sink into the absorption layer, which is likely to cause the deterioration in the picture quality. Therefore, it is necessary to laminate each of the layers while drying each of them by forced heating (for example, at a temperature of 50° C. to 100° C. for three to ten minutes) using a heat source such as a warm air, a heater, or the like.

The inventors of the present invention conducted experiments to examine influences of such film formation condition. First, the absorption layer was dried at a temperature of 30° C. for five minutes after coating by the spin-coating method. Next, the conductive layer and the protect layer were formed in sequence under the similar condition. In this case, a solvent and the metal minute particles included in a conductive layer forming solution sink into the absorption layer to cause deterioration in a conduction characteristic and an antireflection characteristic and further cause a large extent of impairment not only in desired transmittance but also in a function required for the surface treatment film of the display unit.

Meanwhile, the layers were laminated in sequence with the drying condition being changed to a temperature of 60° C. and five minute treating time to form the multi-layered antireflection antistatic film. In this case, no impairment in functions such as the conduction characteristic, the antireflection characteristic, and so forth was caused and a desired value was obtained for the film transmittance and so on.

As described above,the increase in the drying temperature prevents deterioration in the conduction characteristic and the antireflection characteristic and enables the film transmittance to be the desired value. However, when the drying is performed at a higher temperature than a normal temperature as described above, a heating device or a cooling device for the face surface is necessary, which results in increase in facility cost. Meanwhile, the drying at a low temperature needs lengthened treating time to lower productivity.

BRIEF SUMMARY OF THE INVENTION

Therefore, it is an object of the present invention to provide a display unit which has a multi-layered antireflection antistatic film free from external appearance abnormality and superior in a contrast characteristic of a displayed picture. It is another object of the present invention to provide a manufacturing method of a display unit free from external appearance abnormality and superior in a contrast characteristic, under the condition of a relatively low temperature and short treating time without using a large-scaled heating device and cooling device.

The display unit of the present invention includes a face surface and a multi-layered antireflection antistatic film composed of three layers or more which are formed on the face surface. The multi-layered antireflection antistatic film has an absorption layer, a conductive layer, and a protect layer in the order from a face surface side, and the absorption layer includes at least one kind of organic coloring matter, $SiO_2$, and a silane coupling agent, in which the silane coupling agent content is seven times or less by weight the total content of $SiO_2$ and the organic coloring matter.

In the display device of the present invention having the absorption layer, the conductive layer, and the protect layer, the absorption layer includes at least one kind of the organic coloring matter, $SiO_2$, and the silane coupling agent to enable the display device to be free from external appearance abnormality, superior in a contrast characteristic, and superior in productivity.

As the silane coupling agent included in the absorption layer, it is effective to use an agent having at least one functional group selected from, for example, an alkyl group, a vinyl group, a phenyl group, an epoxy group, a carbonyl group, an ether group, a carboxyl group, an ester group, a mercapt group, an amido group, an amino group, a cyano group, and a nitro group.

The organic coloring matter included in the absorption layer preferably has a selective absorption characteristic in a range of 400 nm to 750 nm.

The conductive layer preferably includes metal minute particles or metal compound minute particles including at least one kind of element selected from 3A, 4A, 5A, 6A, 7A, 8, 1B, 2B, 3B, 4B, and 5B groups.

It is preferable that the film transmittance of the absorption layer in the range of 400 nm to 750 nm is 90% to 50%, the film transmittance of the conductive layer in a range of 400 nm to 750 nm is 100% to 70%, and the film transmittance as a multi-layered film is 90% to 40%.

The luminous reflectance of the multi-layered antireflection antistatic film in a range of 400 nm to 750 nm is preferably 2.0% or lower and its surface resistivity is preferably 500 kΩ/square or lower.

The display unit of the present invention is used suitably, for example, as a Braun tube.

DETAILED DESCRIPTION OF THE INVENTION

Embodiments of the present invention will be hereinafter explained with reference to the drawings.

Figure 1:
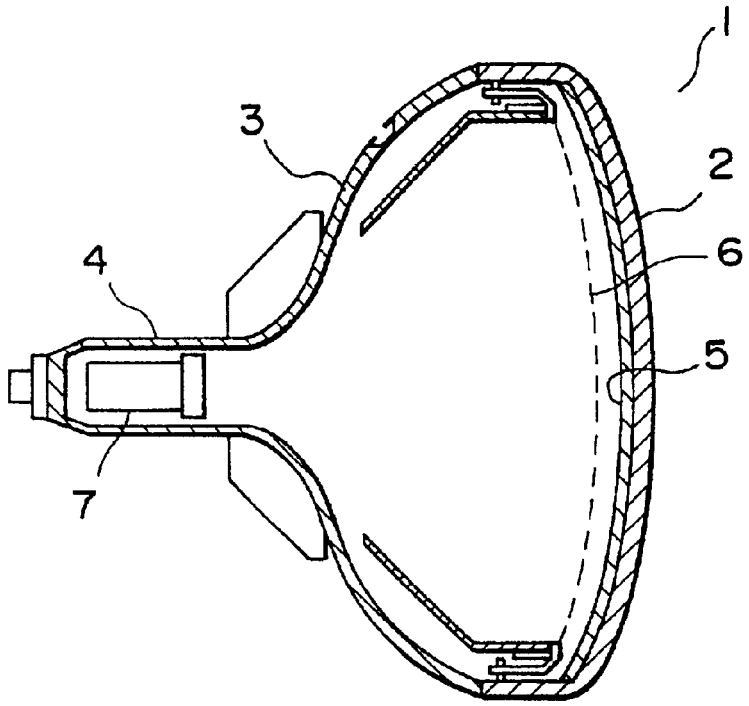
FIG. 1 is a cross-sectional view showing one example of a display unit according to the present invention.

FIG. 1 is a cross-sectional view schematically showing a Braun tube which is one example of a display unit of the present invention. A Braun tube 1 in one embodiment of the present invention is composed of a panel 2, a funnel 3, and a neck 4. On an inner surface of the panel 2, a fluorescence screen 5 made of a tricolor fluorescence layer which emits light in blue, green, and red is disposed. A shadow mask 6 is disposed in a Braun tube 1 facing this fluorescence screen 5. The fluorescence screen 5 is scanned by an electron beam radiated from an electron gun 7 via this shadow mask 6 to display a color picture.

Figure 2:
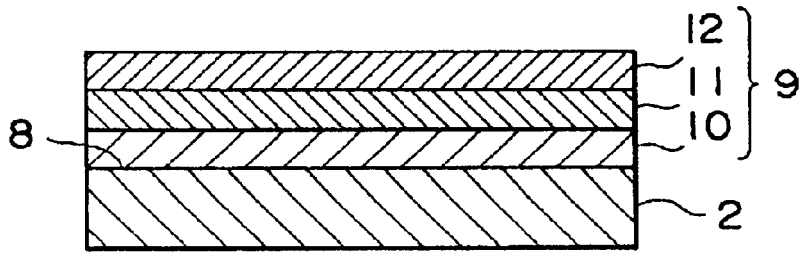
FIG. 2 is a cross-sectional view showing one example of a fragmentary part of the display unit according to the present invention.

FIG. 2 is a cross-sectional view showing one example of a part of the panel 2 of the Braun tube 1 shown in FIG. 1. On a face surface 8 which is an outer surface of the panel 2, a multi-layered antireflection antistatic film 9 is formed. This multi-layered antireflection antistatic film 9 is composed of an absorption layer 10, a conductive layer 11, and a protect layer 12 in the order from the face surface side.

In the present invention, the multi-layered antireflection antistatic film is formed typically on a face surface of a panel made of glass such as the Braun tube panel. However, in the present invention, kinds of materials of a panel which the multi-layered antireflection antistatic film is formed, is not limited to such glass. The multi-layered antireflection antistatic film may be formed on a face surface of the panel made of plastic, for example, acrylic resin, polycarbonate resin, or the like.

The absorption layer includes at least one kind of organic coloring matter, $SiO_2$, and a silane coupling agent (organosilicon compound). As the organic coloring matter used for the absorption layer, a generally known organic pigment and dyestuff can be used. Especially, the use of an organic pigment with low solubility in a solvent and low compatibility with an inorganic substance as the organic coloring matter strengthens the effect of the silane coupling agent. More specifically, the use of the organic pigment and the silane coupling agent at the same time can suppress an occurrence of external appearance abnormality of the multi-layered antireflection antistatic film, deterioration in a contrast characteristic of a displayed picture, and so on.

As the organic coloring matter, for example, a dioxane series coloring matter, an indigo series coloring matter, an azo series coloring matter, an anthraquinone series coloring matter, a quinacridon series coloring matter, and a phthalocyanine series coloring matter can be used.

Specifically, 6,13-bis (phenylamino) triphenodithiazine or the like can be used as the dioxane series coloring matter; thioindigo or the like as the indigo series coloring matter; 1-(1'-naphtylazo)-2-naphthol or the like as the azo series coloring matter, 1,2-dihydroxyanthraquinone or the like as the anthraquinone series coloring matter; 2,9-dimethylquinacrione or the like as the quinacridon series coloring matter; and phthalocyanine or the like as the phthalocyanine series coloring matter, respectively. They may be used independently or two kinds or more of them may be mixed for use.

The organic coloring matter included in the absorption layer preferably has a selective absorption characteristic in a range of 400 nm to 750 nm. Inclusion of the organic coloring matter having the selective absorption characteristic in this range enables color purity of a luminous color to be improved.

The silane coupling agent included in the absorption layer preferably has at least one functional group selected from, for example, an alkyl group, a vinyl group, a phenyl group, an epoxy group, a carbonyl group, an ether group, a carboxyl group, an ester group, a mercapt group, an amido group, an amino group, a cyano group, and a nitro group.

For example, methyltrimethoxysilane can be named as an silane coupling agent having the an alkyl group; for example, vinyltrimethoxysilane as a silane coupling agent having the vinyl group; for example, phenyltriethoxysilane as a silane coupling having the phenyl group; for example, β-(3,4 epoxycyclohexyl)ethyltrimethoxysilane as a silane coupling having the epoxy group; for example, γ-methacryroxypropyltrimethoxysilane as a silane coupling having the ester group; for example, γ-mercaptopropyltrimethoxysilane as a silane coupling agent having the mercapt group; and for example, γ-aminopropyltrimethoxysilane as a silane coupling having the amino group, respectively.

Especially, the use of methyltrimethoxysilane having the alkyl group and vinyltrimethoxysilane having the vinyl group among all of them can effectively suppress the deterioration in a conduction characteristic and an antireflection characteristic.

The reason for adding the silane coupling agent is explained below.

In general, a solution in which the organic coloring matter and $SiO_2$ functioning as a binder is added to low-grade alcohol such as ethanol or the like functioning as a solvent is coated with, and drying treatment and so on are performed to form the absorption layer. However, it is difficult to completely remove a solvent remaining in porous $SiO_2$ by film drying at a temperature of 20° C. to 35° C. for one minute to five minutes and the film is expected to be in a state of wet gel.

Furthermore, a molecule size of organic coloring matter is generally larger than that of $SiO_2$, thereby causing the organic coloring matter to get caught in a skelton structure of porous $SiO_2$, so that its film structure is expected to have less close density than that of a film formed only of $SiO_2$.

Meanwhile, for a solution used for forming the conductive layer, a liquid containing the low-grade alcohol as a major solvent is used from the viewpoint of dispersity of the metal minute particles and coating property. When the conductive layer is formed on the aforesaid absorption layer in a similar method to that for the absorption layer, using such a conductive layer forming solution, the solvent in the conductive layer forming solution sink easily into the absorption layer. Moreover, the metal minute particles are caused to disperse to $SiO_2$ having a porous structure, which prevents sufficient layer separation. Consequently, functions such as the conduction characteristic and the antireflection characteristic required for a surface treatment film of the display unit are likely to be deteriorated.

Therefore, in this invention, the silane coupling agent is added in the absorption layer forming solution, because the silane coupling agent has compatible solubility with the used solvent such as ethanol, does not cause sediment, reacting with the organic coloring matter and $SiO_2$ included in the solution, and suppresses the absorption of the conductive layer into the absorption layer under the drying condition described above which is determined taking productivity into consideration. In this case, the silane coupling agent included in the absorption layer is expected to work as a surface quality improving function which suppresses the absorption of the solvent included in the conductive layer forming solution.

The silane coupling agent has in the same molecule an organic functional group to be bonded with an organic substance and a hydrolysis group reacting with an inorganic substance, and it has a function of bonding the organic substance with the inorganic substance, existing between both of them. In the present invention, for example, the organic functional group portion of the silane coupling agent is bonded with the organic coloring matter and the hydrolysis group portion of that reacts with $SiO_2$.

The silane coupling agent content in the absorption layer is preferably seven times or less by weight the total content of $SiO_2$ and the organic coloring matter. When the silane coupling agent content is more than seven times as high, the effect of suppressing the absorption of the solvent into the absorption layer and so on at the time the conductive layer is formed is weakened.

Furthermore, in order to more effectively suppress the deterioration of the conduction characteristic, the antireflection characteristic, and so on, which is caused by the absorption and the like into the absorption layer, the silane coupling agent is preferably from two to seven times in weight the total content of the organic coloring matter and $SiO_2$. More preferably it is from three to five times.

Incidentally, the hydrolysis group portion of the silane coupling agent forms siloxane bond with $SiO_2$, and the silane coupling agent become a part of a $SiO_2$ matrix structure in the end. Furthermore, this reaction is condensation reaction so that decrease in molecular weight of the silane coupling agent is caused as a result. This is because a subproduct is produced due to the hydrolysis group of the silane coupling agent. Therefore, the weight corresponding to the silane coupling agent remaining in a finally-formed film decreases from an initially added amount.

For example, when a silane coupling agent having the structure of Y—Si—$(X)_3$ is used, the structure in the finally-formed film is expected to be Y—Si—$(O—)_3$, Y—Si—$(O—)_2X$, or Y—Si—$(O—)X_2$, and in any of the structures, the weight (molecular weight) corresponding to X is decreased. Note that Y, X, and (O—) signify the organic functional group, the hydrolysis group, and the siloxane bond of the hydrolysis group with $SiO_2$ respectively.

$SiO_2$included in the absorption layer can be formed mainly of alkoxysilane (in a more wider sense, a hydrolytic silane compound). As alkoxysilane, a silane compound having at least one, more preferably, two or more, or still more preferably, three or more alkoxysilane group(s) can be used. As a specific example of alkoxysilane, silicontetramethoxide, silicontetraethoxide, and so on can be named.

In a coating film made from alkoxysilane, when it undergoes hydrolysis, alcohol is removed and produced OH groups condensate so that the coating film becomes silica sol. This sol is heated and sintered to promote the condensation so that it finally becomes a hard $SiO_2$ coating film. Meanwhile, the silane coupling agent added together with alkoxysilane exists between the organic coloring matter and $SiO_2$ to bond them with each other.

The silane coupling agent content of the absorption layer forming solution is preferably seven times or less the total weight of the solid contents of the organic coloring matter and alkoxysilane excluding the silane coupling agent. More preferably, it is from two to seven times. Still more preferably, it is from three to five times.

Furthermore, it is preferable that the conductive layer includes at least one kind of metal minute particles or metal compound minute particles including an element selected from 3A, 4A, 5A, 6A, 7A, 8, 1B, 2B, 3B, 4B, and 5B groups. Especially when a substance in which the metal minute particles themselves have a light absorption characteristic is used, the conductive layer can have the function of lowering the transmittance of the surface treatment film and improving contrast. As such metal minute particles, one kind or two kinds or more of metal(s) selected, for example, from a group including Fe, Co, Ni, Cr, W, Al, In, Zn, Pb, Sn, Cd, Pd, Cu, Pt, Ag, Ru, Sb, and Au, an alloy of these metals, or a compound of the alloys can be listed. As a specific alloy, for example, an Ag—Pd alloy, an Au—Pd alloy, and so on can be named.

In the present invention, it is preferable that the film transmittance of the absorption layer in the range of 400 nm to 750 nm is 90% to 50%, the film transmittance of the conductive layer in a range of 400 nm to 750 nm is 100% to 70%, and the film transmittance as a multi-layered film is 90% to 40%. Furthermore, the luminous reflectance of the multi-layered antireflection antistatic film in a range of 400 nm to 750 nm is preferably 2.0% or lower. Moreover, when the surface resistivity is made to be 500 kΩ/square or lower, a function such as an electromagnetic shield can be provided.

Next, one example of a manufacturing method of a display unit in the present invention will be described.

As an absorption layer forming solution, a solution containing a solvent, $Si(OCH_3)_4$(silicontetramethoxide), organic coloring matter, and a silane coupling agent is made. Ethanol and so on can be used as the solvent, and as the organic coloring matter, a generally known organic pigment and dyestuff, for example, a dioxane series coloring matter, an indigo series coloring matter, an azo series coloring matter, an anthraquinone series coloring matter, a quinacridon series coloring matter, a phthalocyanine series coloring matter, and so on, can be used.

As the silane coupling agent, a substance having at least one functional group selected from, for example, an alkyl group, a vinyl group, a phenyl group, an epoxy group, a carbonyl group, an ether group, a carboxyl group, an ester group, a mercapt group, an amido group, an amino group, a cyano group, and a nitro group can be used.

Furthermore, $Si(OC_2H_5)_4$(silicontetraethoxide) or the like can be used instead of $Si(OCH_3)_4$(silicontetramethoxide).

The silane coupling agent content of the absorption film forming solution is preferably seven times or less the total added amount of solid contents of the organic coloring matter and $Si(OCH_3)_4$(silicontetramethoxide). When the silane coupling agent content is more than seven times as high, the effect of suppressing absorption of the solvent into an absorption layer at the time of forming a conductive layer is weakened. More preferably, it is from two to seven times, and still more preferably, it is from three to five times.

As a conductive layer forming solution, a solution containing, for example, ethanol or the like as a major solvent and at least one kind of metal minute particles or metal compound minute particles selected from metals belonging to 3A, 4A, 5A, 6A, 7A, 8, 1B, 2B, 3B, 4B, and 5B groups, is made. As such metal minute particles, for example, one kind or two kinds or more of metal(s) selected from a group including Fe, Co, Ni, Cr, W, Al, In, Zn, Pb, Sn, Cd, Pd, Cu, Pt, Ag, Ru, Sb, and Au, an alloy of these metals, or a compound of the alloys can be used. As the alloy, for example, an Ag—Pd alloy, Au—Pd alloy, and so on can be named.

As a protect layer forming solution, a silica solution containing, for example, ethanol or the like as a major solvent and $Si(OCH_3)_4$(silicontetramethoxide) or the like as a parent material is made.

Next, the temperature of a face surface of a display device on which a multi-layered antireflection antistatic film is to be formed is adjusted at 20° C. to 35° C. and this face surface is coated with the absorption layer forming solution. As a coating method, it is preferable to use a wet method such as a spin-coating method in which the solution is dispersed evenly over a surface through the use of a centrifugal force resulting from the rotation of the surface (the face surface) to form a film, or a dipping method in which a uniform film is formed using dispersion due to self-weight of the solution onto the coated surface. After the absorption layer forming solution is coated with, drying treatment is performed under the condition that the temperature is 20° C. to 35° C. and the treating time is one minute to five minutes, to form the absorption layer.

Next, a conductive layer forming solution is coated with, using a similar method, and drying treatment and so on are performed to form the conductive layer on this absorption layer. Furthermore, a protect layer forming solution is coated with, using a similar method, and drying treatment and so on are performed to form a protect layer on this conductive layer.

A film composed of the absorption layer, the conductive layer, and the protect layer which are formed on the face surface in sequence as described above is heat-treated at a temperature of 150° C. to 270° C. for 10 to 200 minutes, so that the display unit of the present invention can be manufactured.

Next, the present invention will be explained with reference to embodiments.

Embodiments 1 to 6

COMPARATIVE EXAMPLES 1 to 3

(1) Prescription of an Absorption Layer Forming Solution

First, a mixing solution including 2.0 wt % of $Si(OCH_3)_4$(silicontetramethoxide), 8.0 wt % of $H_2O$, 0.1 wt % of $HNO_3$ with the remaining portion made from ethanol is prescribed and it is stirred at a temperature of 50° C. for approximately one hour.

Next, a solution composed of 55 wt % of this mixing solution, 10 wt % of a organic coloring matter dispersion solution containing pigment, a silane coupring agent in the rations shown in Table 1, and IPA (isopropyl alcohol) as the remains, is stirred for approximately 30 minutes to prescribe an absorption layer forming solution.

Incidentally, the organic coloring matter dispersion solution is composed of 2.4 wt % of dioxazineviolet and isopropyl alcohol as the remains.

TABLE 1

| | Silane Coupling Agent | Added Amount (relative to $SiO_2$ & Coloring Matter Solid Content) |
|---|---|---|
| Embodiment 1 | Methyltrimethoxysilane | 3 wt % (2.2 times) |
| Embodiment 2 | | 5 wt % (3.7 times) |
| Embodiment 3 | | 7 wt % (5.2 times) |
| Comparative Example 1 | | 10 wt % (7.5 times) |
| Embodiment 4 | Vinyltrimethoxysilane | 3 wt % (2.2 times) |
| Embodiment 5 | | 5 wt % (3.7 times) |
| Embodiment 6 | | 7 wt % (5.2 times) |
| Comparative Example 2 | | 10 wt % (7.5 times) |
| Comparative Example 3 | — | 0 wt % |

(2) Prescription of a Conductive Layer Forming Solution

A conductive layer forming solution containing ethanol as its major solvent and Ag—Pd alloy particles (0.3 wt %) is prescribed.

(3) Prescription of a Protect Layer Forming Solution

A mixing solution containing 1.0 wt % of $Si(OCH_3)_4$ (silicontetramethoxide), 4.0 wt % of $H_2O$, 0.1 wt % of $HNO_3$, and 60 wt % of ethanol, and IPA as the remains is prescribed and it is stirred at a temperature of 50° C. for approximately one hour, to prescribe a protect layer forming solution.

(4) Formation of a Multi-layered Antireflection Antistatic Film

The temperature on a face surface of a Braun tube is adjusted at 30° C., the face surface is next coated with the absorption layer forming solution for forming the absorption layer which is the first layer, the face surface is next kept rotated at a rotation speed of 150 rpm for one minute to thin the film, and thereafter, the face surface is dried while being rotated at a rotation speed of 100 rpm for three minutes under the environment in which the temperature is 25° C.

and the absolute humidity is 1 g/m$^3$, to form the absorption layer. Subsequently, the conductive layer which is the second layer and the protect layer which is the third layer are formed in sequence under the same condition as in the formation of the absorption layer, and thereafter, heating treatment is performed at a temperature of 180° C. for 15 minutes.

Regarding characteristics of thus formed multi-layered antireflection antistatic film, an external appearance of the film is checked and luminous reflectance, surface resistivity, and transmittance of the multi-layered film are measured. The result is shown in Table 2.

Note that, in the external appearance assessment in Table 2, O signifies a film where the color of the film is uniform over the whole face surface without uneven color being recognized and no defect like repeling liquid is recognized, and X signifies a film where the color of the film is uneven in some places over the face surface and defect like repeling liquid is recognized.

Meanwhile, when the absorption layer and the conductive layer are independently formed as single-layered films, using solutions to which the silane coupling agent is added within the range of the present invention, and the film transmittance of each of the single-layered films is measured, the film transmittance of the single layer of the absorption layer is 76% and that of the single layer of the conductive layer is 80%, and assuming the transmittance of the protect layer is 100%, the transmittance as a multi-layered film is approximately 61% based on calculation.

TABLE 2

| | External Appearance of Film | Luminous Reflectance | Surface Resistibility (Ω/sqare) | Transmittance of Multi-Layered Film (%) |
|---|---|---|---|---|
| Embodiment 1 | ○ | 1.8 | $4 \times 10^3$ | 73 |
| Embodiment 2 | ○ | 0.6 | $7 \times 10^2$ | 62 |
| Embodiment 3 | ○ | 1.4 | $9 \times 10^4$ | 68 |
| Comparative Example 1 | X | 3.2 | $>10^7$ | 93 |
| Embodiment 4 | ○ | 1.7 | $8 \times 10^3$ | 70 |
| Embodiment 5 | ○ | 0.7 | $8 \times 10^2$ | 63 |
| Embodiment 6 | ○ | 1.5 | $2 \times 10^4$ | 72 |
| Comparative Example 2 | X | 2.6 | $>10^7$ | 88 |
| Comparative Example 3 | X | 2.8 | $>10^7$ | 90 |

In Embodiment 2 and Embodiment 5, the film transmittance is substantially the same as the aforesaid calculated transmittance values and no external appearance abnormality of the film is recognized, and furthermore it can be said that the luminous reflectance and the surface resistivity are also substantially the same as those of a generally known two-layered antireflection antistatic film.

In Embodiments 1, 3, 4, and 6, the transmittance as a multi-layered film is higher than the calculated value, which is considered to result from some absorption of the conductive layer into the absorption layer, but no external appearance abnormality of the film is recognized, and the luminous reflectance and the surface resistivity satisfy performance which is required for a surface treatment film of a display unit.

In Comparative Examples 1 and 2, the absorption of the conductive layer into the absorption layer is recognized and external appearance abnormality to some extent is recognized. Meanwhile, in Comparative Example 3 where the silane coupling agent is not added to the absorption layer forming solution, the absorption of the conductive layer into the absorption layer is recognized as the external appearance abnormality. Moreover, in Comparative Example 3, the luminous reflectance and the surface resistivity are a little worse compared with other samples.

It has been found out from these results that, when the added amount of the silane coupling agent is more than seven times as large as the solid content weight of a coloring matter and $SiO_2$, the effect of the silane coupling agent is weakened, and therefore, the added amount of the silane coupling agent is preferably seven times or less.

Embodiment 7

COMPARATIVE EXAMPLES 4 and 5

Embodiment 7

(1) Prescription of an Absorption Layer Forming Solution

First, a mixing solution containing 2.0 wt % of $Si(OCH_3)_4$(silicontetramethoxide), 8.0 wt % of $H_2O$, 0.1 wt % of $HNO_3$ with the remaining portion made from ethanol is prescribed and it is stirred at a temperature of 50° C. for approximately one hour.

Next, a solution composed of 55 wt % of this mixing solution, 4 wt % of a organic coloring matter dispersion solution containing pigment, 5 wt % of a silane coupring agent (methyltrimethoxysilane), and IPA (isopropyl alcohol) as the remains, is stirred for approximately 30 minutes to prescribe an absorption layer forming solution.

Incidentally, the organic coloring matter dispersion solution is composed of 2.4 wt % of dioxazineviolet and isopropyl alcohol as the remains.

(2) Prescription of a Conductive Layer Forming Solution

A conductive layer forming solution containing ethanol as its major solvent and Ag—Pd alloy particles (0.3 wt %) is prescribed.

(3) Prescription of a Protect Layer Forming Solution

A mixing solution containing 1.0 wt % of $Si(OCH_3)_4$ (silicontetramethoxide), 4.0 wt % of $H_2O$, 0.1 wt % of $HNO_3$, and 60 wt % of ethanol, and IPA as the remains is prescribed and it is stirred at a temperature of 50° C. for approximately one hour, to prescribe a protect layer forming solution.

(4) Formation of a Multi-layered Antireflection Antistatic Film

The temperature on a face surface of a Braun tube is adjusted at 30° C., the face surface is next coated with the absorption layer forming solution for forming the absorption layer which is the first layer, the face surface is next kept rotated at a rotation speed of 150 rpm for one minute to thin the film, and thereafter, the face surface is dried while being rotated at a rotation speed of 100 rpm for three minutes under the condition that the temperature is 25° C. and the absolute humidity is 1 g/m$^3$, to form the absorption layer. Subsequently, the conductive layer which is the second layer and the protect layer which is the third layer are formed in sequence under the same condition as in the formation of the absorption layer. Thereafter, heating treatment is performed at a temperature of 180° C. for 15 minutes.

Incidentally, this multi-layered film is formed in each of 20 Braun tubes. Meanwhile, when the absorption layer and the conductive layer are independently formed as single-layered films, using the solutions in this embodiment, and the film transmittance of each of the single-layered films is measured, the film transmittance of the single layer of the absorption layer is 80% and that of the single layer of the conductive layer is 80%, and assuming the transmittance of the protect layer is 100%, the transmittance as a multi-layered film is approximately 64% based on calculation.

COMPARATIVE EXAMPLES 4 and 5

As Comparative Examples 4 and 5, a two-layered antireflection antistatic film composed of a conductive layer made of metal minute particles and a protect layer made of $SiO_2$ is formed. This two-layered film is formed in 20 Braun tubes in each of Comparative Examples 4 and 5. Incidentally, the solid content of the metal minute particles is formed to be a two-layered film and its transmittance is adjusted to 80% in Comparative Example 4 and 65% in Comparative Example 5.

Regarding characteristics of thus formed surface treatment films in Embodiment 7 and Comparative Examples 4 and 5, the number of films where abnormality is recognized at the time of external appearance check, and luminous reflectance, surface resistivity, and transmittance of the multi-layered film are measured. The result is shown in Table 3.

TABLE 3

| | Number of Films with Recognized External Appearance Abnormality | Luminous Reflectance | Surface Resistibility (Ω/square) | Transmittance of Multi-Layered Film (%) |
|---|---|---|---|---|
| Embodiment 7 | 0/20 | 0.6 | $7 \times 10^2$ | 65 |
| Comparative Example 4 | 0/20 | 0.5 | $6 \times 10^2$ | 80 |
| Comparative Example 5 | 4/20 | 0.5 | $6 \times 10^2$ | 65 |

As shown in Table 3, Embodiment 7 satisfies performance required for a surface treatment film of a display unit. In the conventional two-layered film in Comparative Example 4 where the film transmittance is relatively high, no characteristic problem occurs. In Comparative Example 5 where the transmittance is the same as in Embodiment 7, external appearance abnormality (uneven coating) of the film occurs, which is a problem from a manufacturing point of view.

In the multi-layered film of the present invention, uneven coating is not easily noticeable even in a region where the transmittance is low because the transmittance of this multi-layered film is controllable by the two layers containing the absorption layer containing the organic coloring matter and the conductive layer containing the metal minute particles. Therefore, they are only required to be laminated in a region having the transmittance equal to that of the two-layered antireflection antistatic film which has already been put into practical use, and the uneven coating is not easily noticeable unless the absorption layer and the conductive layer have the uneven coating in the same position. On the other hand, in the conventional two-layered film, the uneven coating tends to be more noticeable as the transmittance is lowered.

What is claimed is:

1. A display unit, comprising:

a face surface; and a multi-layered antireflection antistatic film composed of three layers or more which are formed on said face surface, wherein said multi-layered antireflection antistatic film has an absorption layer, a conductive layer, and a protect layer in the order from a face surface side, wherein the absorption layer includes at least one kind of organic coloring matter, $SiO_2$, and a silane coupling agent, and silane coupling agent content in the absorption layer is from two to seven times as high as total content of $SiO_2$ and the organic coloring matter.

2. A display unit according to claim 1, wherein the silane coupling agent content is from three to five times as high as the total content of $SiO_2$ and the organic coloring matter.

3. A display unit according to claim 1, wherein the silane coupling agent has at least one functional group selected from an alkyl group, a vinyl group, a phenyl group, an epoxy group, a carbonyl group, an ether group, a carboxyl group, an ester group, a mercapt group, an amido group, an amino group, a cyano group, and a nitro group.

4. A display unit according to claim 1, wherein the conductive layer contains at least one kind of metal minute particles or metal compound minute particles including at least one kind of element selected from 3A, 4A, 5A, 6A, 7A, 8, 1B, 2B, 3B, 4B, and 5B groups.

5. A display unit according to claim 1, wherein the absorption layer includes at least one kind of organic coloring matter having a selective absorption characteristic in a range of 400 nm to 750 nm.

6. A display unit according to claim 1, wherein film transmittance of the absorption layer in a range of 400 nm to 750 nm is 90% to 50%, film transmittance of the conductive layer in a range of 400 nm to 750 nm is 100% to 70%, and film transmittance as a multi-layered film is 90% to 40%.

7. A display unit according to claim 1, wherein luminous reflectance of said multi-layered antireflection antistatic film in a range of 400 nm to 750 nm is 2.0% or lower.

8. A display unit according to claim 1, wherein surface resistivity of said multi-layered antireflection antistatic film is 500 kΩ/square or lower.

9. A display unit according to claim 1, wherein said display unit is a Braun tube.

* * * * *